US005542315A

United States Patent [19]

Carroll, III et al.

[11] Patent Number: 5,542,315

[45] Date of Patent: Aug. 6, 1996

[54] ELEPHANT'S FOOT ADJUSTING SCREW ASSEMBLY FOR INTERNAL COMBUSTION ENGINE

[75] Inventors: John T. Carroll, III; Joseph C. Bentz; David P. Genter, all of Columbus, Ind.

[73] Assignees: Cummins Engine Company, Inc., Columbus, Ind.; Toshiba Corp., Tokyo, Japan

[21] Appl. No.: 263,232

[22] Filed: Jun. 21, 1994

[51] Int. Cl.[6] ..... F01L 1/16

[52] U.S. Cl. ..... 74/586; 74/579 R; 123/508; 123/90.48

[58] Field of Search ..... 74/586, 579 R; 123/90.48, 90.51, 90.61, 507, 508, 509, 495; 403/122, 135, 137, 138, 144

[56] References Cited

U.S. PATENT DOCUMENTS

| | | | |
|---|---|---|---|
| 3,101,402 | 8/1963 | Gondek | 123/90.61 |
| 4,833,977 | 5/1989 | Haahtela et al. | 92/212 |
| 4,848,286 | 7/1989 | Bentz | 123/90.61 |
| 4,966,108 | 10/1990 | Bentz et al. | 123/90.51 |
| 5,195,489 | 9/1993 | Reich | 123/321 |
| 5,279,211 | 1/1994 | Bentz et al. | 92/248 |

*Primary Examiner*—Charles A. Marmor
*Assistant Examiner*—Chong H. Kim
*Attorney, Agent, or Firm*—Sixbey, Friedman, Leedom & Ferguson

[57] ABSTRACT

A sliding friction- and wear-resistant elephant's foot or swivel pad adjusting screw assembly for contacting an actuating member interface in an internal combustion engine is provided to transmit arcuate motion into reciprocal motion. The assembly includes a metal screw element configured to move along an arcuate path in a correspondingly configured socket in a ceramic pad element. A retainer element secures the pad element to the screw element loosely to allow this relative motion. The ceramic pad element includes a planar contact face for contacting a corresponding planar contact surface on an internal combustion engine actuating member, such as a valve, a valve crosshead or a unit fuel injector.

12 Claims, 2 Drawing Sheets

ELEPHANT'S FOOT ADJUSTING SCREW ASSEMBLY FOR INTERNAL COMBUSTION ENGINE

TECHNICAL FIELD

The present invention relates generally to contact interfaces between mechanically driven actuating and actuated members in internal combustion engines and specifically to an assembly for a contact interface between an actuating member and an actuated member of an internal combustion engine that minimizes sliding friction and wear at the interface.

BACKGROUND OF THE INVENTION

The harsh operating conditions encountered in an internal combustion engine, particularly the high temperatures and high pressures, cause engine components to wear rapidly. Mechanically driven actuators and actuating components are especially susceptible to wear in this environment. An actuating component-actuator interface in which the interface contact is accompanied by sliding motion is likely to experience undesirable sliding wear and sliding friction. Consequently, the materials used for producing such engine actuating components should provide good mechanical strength, thermal stability and wear resistance, particularly sliding wear resistance. Metals have typically been used to form such components. Ceramics, such as zirconia, silicon nitride, silicon carbide and the like, have been found to exhibit excellent mechanical strength, thermal stability and wear resistance. However, ceramics, despite their promise as wear-resistant engine components, are often hard and brittle and lack the formability and workability of metals which are conventionally applied to low cost precision engine components.

Composites formed from a ceramic element and a metal element have been proposed to overcome the aforementioned limitations. Although ceramic and metallic composite structures useful as internal combustion engine components are available, a ceramic-metal composite structure sufficiently reliable and durable for use as an actuating component adjusting screw element in an internal combustion engine environment has not heretofore been commercially available.

The prior art has proposed ceramic-metal composites useful in internal combustion engines that are secured together by various kinds of connecting elements. For example, U.S. Pat. No. 4,883,911 to Haahtela discloses a ceramic piston ring carrier held in place on a metal piston by casting in or with a locking ring to improve force transmission and frictional conditions between the piston and the cylinder. U.S. Pat. No. 4,848,286 to Bentz, assigned to Cummins Engine Co., the assignee of the present invention, discloses the use of an external metal connector for joining ceramic and metal components of a pivot rod. Neither of these patents, however, suggests that the arrangement described therein could be used to secure a ceramic element to a metal element to form the kind of sliding friction and sliding wear-resistant interface required in an engine actuating component which is required to transmit arcuate motion to reciprocal motion.

U.S. Pat. No. 4,966108 to Bentz et al. and commonly owned by the assignee of the present application discloses an internal combustion engine ball and socket joint assembly that includes an interface which is subject to high contact stresses, particularly those produced by highly loaded sliding contact. One of the joint components is formed of a metallic material, and the other component is formed of a high density ceramic material. The ceramic material is sintered and may include rare earth metals such as yttrium oxide or may include aluminum oxides. This construction is capable of withstanding the compressive loads experienced by an internal combustion engine ball and socket joint. However, sliding wear and sliding friction are not typically encountered in this type of joint.

U.S. Pat. No. 5,279,211 to Bentz et al., also owned by the assignee of the present invention, describes a wear-resistant metal and ceramic composite capable of withstanding the stresses produced in the interface in mechanically actuated internal combustion components such as a compression brake master piston or hydraulic tappet cam follower. The retainer structure used to hold the ceramic and metal components together in this composite securely retains the ceramic pad within the metal in a manner which prohibits relative movement between the metal and the ceramic. Some internal combustion engine actuator components, particularly components of the "elephant's foot" type designed for use in valves, valve crossheads and fuel injectors, require rotatably unconstrained attachments between actuator elements to allow them to function effectively. Therefore, the arrangement described in Pat. Nos. 4,966,108 and 5,279,211 is not applicable to such components.

Sliding friction and sliding wear present problems in several contact interfaces in internal combustion engines. Actuated members, such as engine valves, valve crossheads and unit type fuel injectors contact actuating members thousands of times each minute during engine operation. The adjusting screw assemblies associated with these interfaces tend to produce undesirable sliding friction and sliding wear at the actuated member interface, which ultimately interferes with the proper functioning of the adjusting screw assembly.

U.S. Pat. No. 5,195,489 to Reich discloses a link structure for an internal combustion engine which comprises providing a convex shape to one end of a compression release engine retarder push rod associated with a master or slave piston, while the interfacing surface of the piston is flat so that the convex end rolls rather than slides. This arrangement may minimize the need for grinding or polishing the surfaces or the need for lubrication at the interface. However, it is not suggested that any of the interfacing structures could be formed of a structural ceramic to address problems arising from wear and heat generation by friction at the interfacing surfaces.

Problems commonly associated with sliding friction include parasitic loss, heat generation and frictional forces, which prevent optimum engine function. For example, the sliding friction loss between the rocker levers and valve crossheads in a heavy duty diesel engine can be 0.5 HP (horsepower). This loss, which is equivalent to a reduction in brake specific fuel consumption (b.s.f.c.) of 0.2%, generates heat that must be removed by the engine's cooling system. Friction forces generated in the type of sliding contact that occurs between a rocker lever and valve crosshead are transferred to the adjacent valve components. This produces additional sliding friction, wear and component failure.

Sliding wear can produce a range of problems from cosmetic surface deterioration to loss of mechanical set or calibration to the increased likelihood of catastrophic failure of the worn component, which prior art ceramic and metal composite structures available for internal combustion engines have not solved.

The prior art, therefore, has failed to provide a ceramic-metal composite for an internal combustion engine component which provides a loose attachment of the ceramic element to the metal element in a way that permits rotatably unconstrained movement between the ceramic and metal elements and substantially reduces sliding wear and sliding friction. A need exists for such a ceramic-metal composite, particularly for internal combustion engine adjusting screw assemblies.

SUMMARY OF THE INVENTION

It is a primary object of the present invention, therefore, to overcome the disadvantages of the prior art and to provide a sliding wear-resistant ceramic-metal composite for an internal combustion engine actuating member adjusting screw.

It is another object of the present invention to provide a reliable and durable ceramic-metal composite adjusting screw assembly for an internal combustion engine which substantially eliminates the problems associated with sliding friction and sliding wear.

It is a further object of the present invention to provide a ceramic-metal composite adjusting screw assembly for an internal combustion engine which allows relative movement between the ceramic element and the metallic element of the composite while substantially eliminating sliding wear.

It is yet another object of the present invention to provide an elephant's foot or swivel pad adjusting screw assembly for an internal combustion engine which reduces friction induced side loads to actuated components.

It is yet a further object of the present invention to provide an elephant's foot or swivel pad adjusting screw assembly for an internal combustion engine which improves brake specific fuel consumption.

The aforesaid objects are accomplished by providing a sliding wear-resistant adjusting screw assembly for an actuator member in an internal combustion engine intended to contact an actuated member, such as an engine valve, valve crosshead or unit type fuel injector at an interface. The adjusting screw assembly includes a metal screw element and a ceramic pad element. The metal element and the ceramic element are complimentary configured and held together by a retaining element that permits relative movement between the metal and ceramic elements at the metal-ceramic joint. This arrangement avoids the sliding friction losses and sliding wear losses which are common with adjusting screw assemblies presently used in connection with internal combustion engine actuating members.

Other objects and advantages will be apparent from the following description, claims and drawings.

DESCRIPTION OF THE PREFERRED EMBODIMENTS

Figure 4:
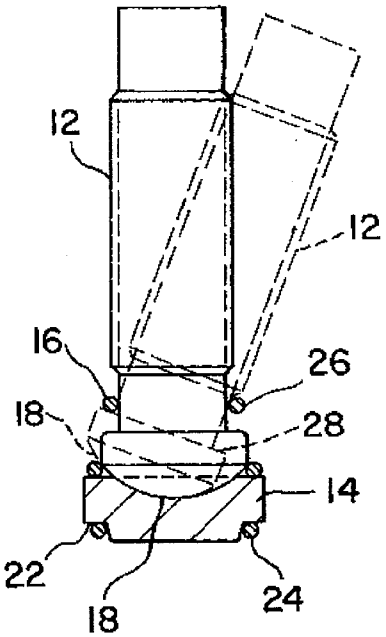
FIG. 4 is a partial cross-sectional front view of the adjusting screw of the present invention showing the relative movement between the metal and ceramic elements.

The present invention addresses the problems related to sliding friction and wear in a variety of internal combustion engine applications, including valve crossheads and unit fuel injectors by cost effectively incorporating an advanced structural ceramic element in the kind of adjusting screw assembly known as an "elephant's foot" or swivel pad adjusting screw assembly. Structural ceramics, particularly silicon nitride, have consistently been demonstrated in both laboratory tests and in a broad range of commercial applications to provide superior wear and friction performance compared to metals. The assignee of the present invention's experience with structural ceramics, including silicon nitride, confirms these benefits. The present invention offers substantial economic and performance advantages over commercially available adjusting screw assemblies made entirely of metal.

Adjusting screws, sometimes referred to as lash adjusting screws, are usually used in internal combustion engines where it is necessary to adjust the stroke of an engine actuating component, such as, for example, a valve crosshead or unit fuel injector plunger. The motion of link structures associated with these components requires relative movement between interfacing surfaces of the adjusting screw elements to transmit actuating movement to the engine actuating component. The metal structures customarily used to form these elements required grinding and polishing, as well as proper lubrication, to allow the elements to function and to minimize wear. The elephant's foot or swivel pad adjusting screw assembly of the present invention minimizes expensive ceramic grinding and polishing manufacturing operations and application lubrication requirements.

Referring to the drawings, FIGS. 1–4 illustrate the adjusting screw assembly of the present invention in various stages of assembly.

Figure 1:
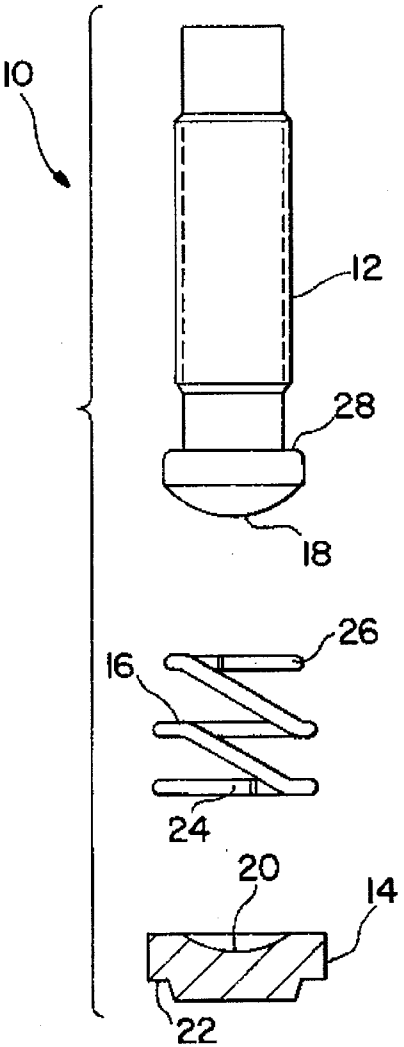
FIG. 1 is an exploded, partial cross-sectional front view of the components of the adjusting screw assembly of the present invention.

FIG. 1 shows the component parts of the adjusting screw assembly of the present invention completely unassembled. The complete assembly 10 includes three elements: a screw member 12, an integral wear-resistant slider pad and socket 14 and a retainer element 16. The screw element 12 is preferably formed from steel that has been threaded, heat treated and tumbled. The material removal operations typically performed on steel internal combustion engine components are not required with the design of the present invention. The screw element 12 includes a rounded terminus or ball portion 18 which has an offset radius design to achieve annular contact in a spherical socket 20 in the pad element 14.

The pad element 14 is made from a ceramic material, preferably silicon nitride. Silicon nitride powders are die pressed and pressureless sintered to produce the configuration shown in the drawings. The shallow spherical socket 20 receives the ball portion 18 of the screw element 12. The sintered ceramic pad 14 is preferably tumbled to break any sharp edges and improve the surface finish of the ceramic.

The retainer element 16 is preferably made of spring steel wire. Conventional "wound on mandrel" processes and tooling may be used to form the retainer element. The retainer element 16 securely captures the ceramic pad 14, which includes an annular ledge 22 to engage one end 24 of the retainer element 16. The screw element 12 is loosely attached to the pad 14 by the other end 26 of the retainer element 16. The screw element also includes an annular ledge 28, which is significantly larger in diameter than the diameter of the screw element. The end 26 of the retainer element 16 is retained on the screw element slightly above the annular ledge 28.

Figure 3:
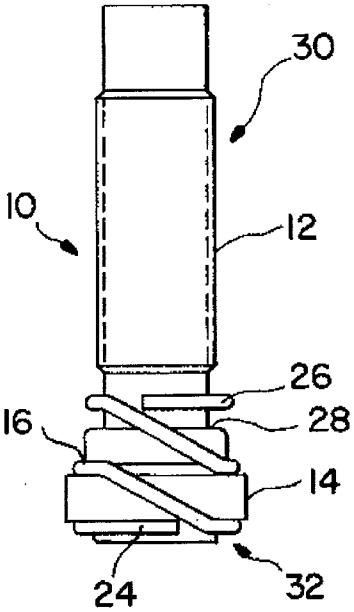
FIG. 3 is a front view of the adjusting screw of the present invention completely assembled.
Figure 2:
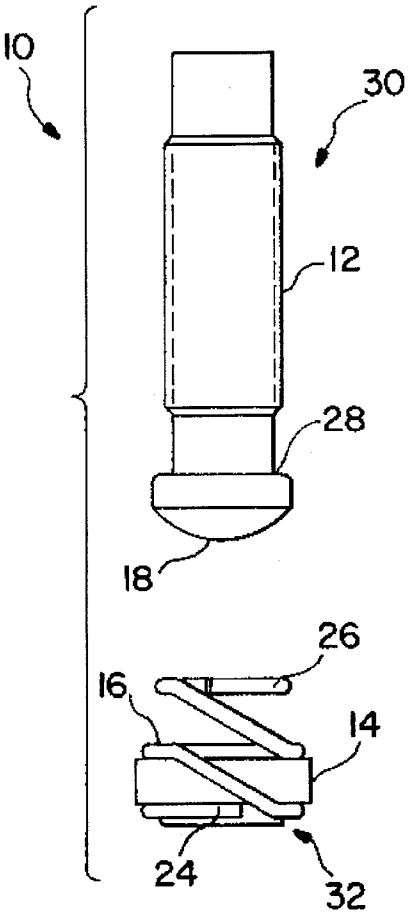
FIG. 2 is an exploded front view of the two main subassemblies of the adjusting screw of the present invention.

The final adjusting screw assembly, which is shown completely assembled in FIGS. 3 and 4, consists of only two subassemblies, which are shown in FIG. 2: the screw 30 and pad/retainer subassembly 32. FIG. 4 shows, in dashed lines, the relative movement of the ball portion 18 of the screw element 12 in the socket 20 of the pad 14.

The retainer element 16 will experience little, if any, dynamic loading because of its design. Therefore, the retainer 16 is a nonparticipating member in situations when lash between the adjusting screw assembly 10 and the engine actuated member is insufficient to allow an unretained pad to escape.

Figure 7:
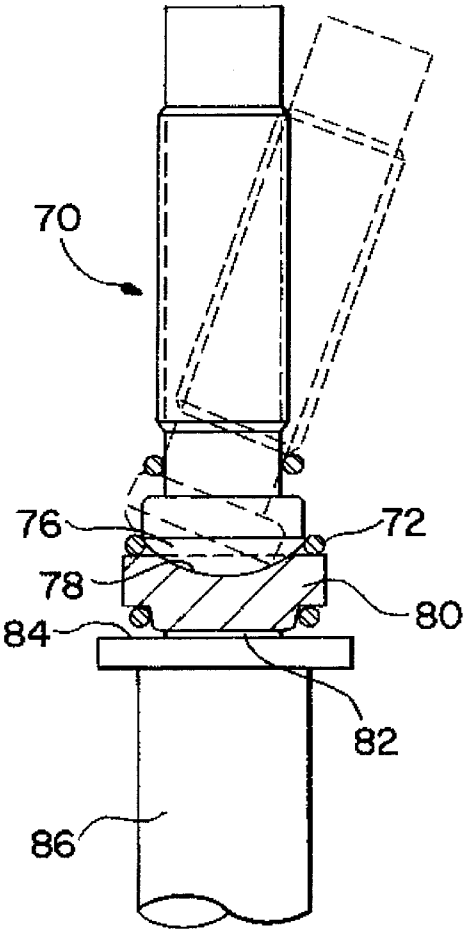
FIG. 7 illustrates the elephant's foot adjusting screw of the present invention in place as an actuator link in a unit fuel injector.
Figure 6:
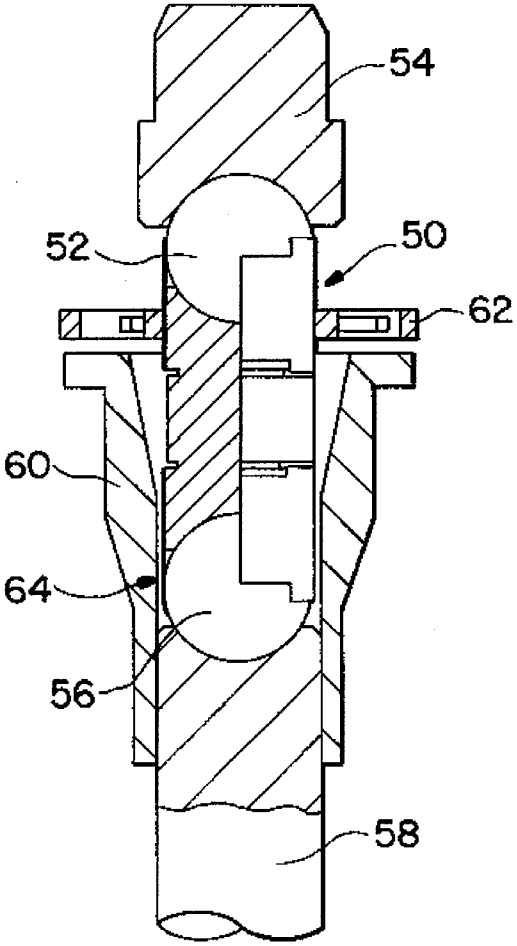
FIG.6 PRIOR ART
FIG. 6 illustrates a second type of prior art fuel injector actuator link.
Figure 5:
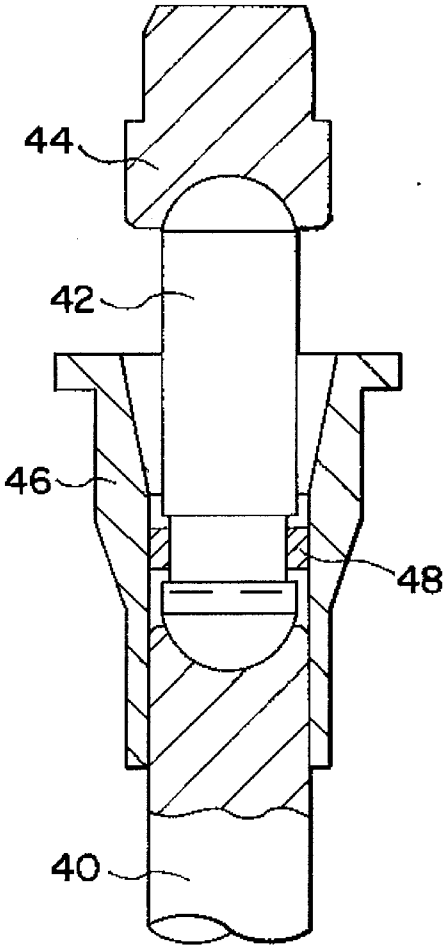
FIG.5 PRIOR ART
FIG. 5 illustrates one type of prior art fuel injector actuator link.

FIG. 7 illustrates one application of the adjusting screw assembly of the present invention in a link for transmitting movement to an engine actuation member, a unit fuel injector. FIGS. 5 and 6 illustrate two different prior art injector actuator links, also in a unit fuel injector.

FIG. 5 shows a link conventionally used to transmit reciprocal movement to the plunger 40 of a unit fuel injector (not shown). A link 42 engages a socket 44 of a connecting rod (not shown) or similar structure. A coupling structure 46 and a retainer 48 hold the link in place as it reciprocates with the plunger 40.

FIG. 6 illustrates a ball link 50 that can be used for the same purpose. A first ball 52 at one end of the link 50 engages a socket 54, and a second ball 56 at the opposite end of the link 50 engages the fuel injector plunger 58. This arrangement also requires a coupling 60. A link retainer 62 is required to retain the link 50 in the coupling 60. A ball retainer 64 is also needed to maintain the balls 52 and 56 in their proper positions.

In distinct contrast, the adjusting screw assembly 70 of the present invention does not require a coupling structure, and needs only one simple retainer element 72 both to hold the assembly together and to permit the movement required to effectively transmit arcuate motion to the reciprocal motion required to actuate the fuel injector. The screw element ball portion 76 can move freely in the socket 78 of the ceramic pad 80 without the sliding wear and friction problems of the prior art. The contact surface 82 of the pad 80 does not require a specially machined socket, but contacts a flat surface 84 on the fuel injector plunger 86 to actuate the injector. This arrangement substantially eliminates the parasitic loss, heat generation and frictional forces associated with sliding friction in the currently available all metal adjusting screw assemblies.

Industrial Applicability

The elephant's foot or swivel pad adjusting screw of the present invention will find its primary application in association with actuated members such as valves, valve crossheads and unit fuel injectors in an internal combustion engine, particularly a diesel engine. However, the design of this assembly will be useful in any system wherein reciprocating motion is coupled to arcuate motion to avoid the problems accompanying sliding wear, including surface deterioration, loss of mechanical set or calibration and component failure.

We claim:

1. A sliding wear and friction-resistant adjusting screw assembly designed to transmit motion along an arcuate path to the reciprocal motion required for actuation of an internal combustion engine actuating member, said adjusting screw assembly comprising:

(a) screw element means for transmitting arcuate motion to said engine actuating member, wherein said screw element means is made of metal and includes an arcuate contact face, an axial body portion with a constant axial diameter, and a terminal foot portion with an annular ledge section having a larger diameter than said axial body portion between said axial body portion and said arcuate contact face;

(b) pad element means for contacting said engine actuating member, wherein said pad element means is made of a structural ceramic and includes in one surface socket means configured for receiving said screw element means arcuate contact face and on an opposed surface planar contact means for forming an interface with said engine actuating means, and said pad element means has a larger diameter portion containing said socket means and a smaller diameter portion including said planar contact face with an annular shoulder therebetween; and (c) retainer element means for securely but loosely holding said pad element means to said screw element means to allow arcuate movement of said screw element means relative to said pad element means, wherein said retainer element means has a substantially helical configuration, wherein one end of said retainer element means engages said screw element means annular ledge section and the other end of said retainer element means engages said pad element means annular shoulder so that said arcuate contact face is held in said socket means.

2. The adjusting screw assembly described in claim 1, wherein said screw element means is made of steel and said pad element means is made of silicon nitride.

3. The adjusting screw assembly described in claim 1, wherein said screw element means includes an axial body portion with a constant axial diameter and a terminal foot portion with an annular ledge section having a larger diameter than said axial body portion between said axial body portion and said arcuate contact face.

4. The adjusting screw assembly described in claim 1, wherein said arcuate contact face has substantially the same radius of curvature as said socket means.

5. The adjusting screw assembly described in claim 1, wherein said screw element means is made of steel, said pad element means is made of silicon nitride and said retainer element means is made of spring steel.

6. A link assembly for an internal combustion engine for actuating a unit fuel injector by transmitting the arcuate motion transmitted to the link assembly into the reciprocal motion required to actuate the unit fuel injector, wherein said link assembly includes an adjusting screw assembly comprising:

(a) screw element means for transmitting arcuate motion to said engine actuating member, wherein said screw element means is made of metal and includes arcuate contact face, an axial body portion with a constant axial diameter, and a terminal foot portion with an annular ledge section having a larger diameter than said axial body portion between said axial body portion and said arcuate contact face;

(b) pad element means for contacting said unit fuel injector, wherein said pad element means is made of a structural ceramic and includes in one surface socket means configured for receiving said screw element means arcuate contact face and on an opposed surface planar contact means for forming an interface with said unit fuel injector, and wherein said pad element means has a larger diameter portion containing said socket means and a smaller diameter portion including said planar contact face with an annular shoulder therebetween; and (c) retainer element means for securely but loosely holding said pad element means to said screw element means to allow arcuate movement of said screw element means relative to said pad element means, wherein said retainer element means has a substantially helical configuration, wherein one end of said retainer element means engages said screw element means annular ledge section and the other end of said retainer element means engages said pad element means annular shoulder so that said arcuate contact face is held in said socket means.

7. The link assembly described in claim 6, wherein said screw element means is made of steel and said pad element means is made of silicon nitride.

8. The link assembly described in claim 6, wherein said arcuate contact face has substantially the same radius of curvature as said socket means.

9. The link assembly described in claim 6, wherein said retainer element means is made of spring steel.

10. A sliding wear and friction-resistant adjusting screw assembly capable of rotatably unconstrained movement to transmit motion along an arcuate path to the reciprocal motion required for actuation of an internal combustion engine actuating member, wherein said adjusting screw assembly comprises a metal screw element with a rounded terminus portion, a ceramic pad element including on one surface a socket complimentarily configured to receive said screw element terminus portion and on the opposite surface an actuating member contact surface, and a retainer element having a generally helical configuration contacting both an annular ledge on said screw element and an annular shoulder on said pad element to secure said screw element to said pad element to permit the rotatably unconstrained movement of the screw element terminus portion in the pad element socket.

11. The adjusting screw assembly of claim 10, wherein the terminus portion and the socket have the same radius of curvature.

12. The adjusting screw assembly of claim 10, wherein the screw element is made of steel, the pad element is made of silicon nitride, and the retainer element is made of spring steel.

* * * * *